US011486147B2

(12) United States Patent
Bevernage et al.

(10) Patent No.: US 11,486,147 B2
(45) Date of Patent: Nov. 1, 2022

(54) SET OF PANELS, METHOD FOR MANUFACTURING SUCH SET OF PANELS, ASSEMBLY OF THE PANELS AND LOCKING PROFILE USED IN SAID PANELS

(71) Applicant: Beaulieu International Group NV, Waregem (BE)

(72) Inventors: Leo Marie Richard Bevernage, Koksijde (BE); Leif Kare Hindersland, Lyngdal (NO); Dag Arnes, Lyngdal (NO)

(73) Assignee: Beaulieu International Group NV, Waregem (BE)

( * ) Notice: Subject to any disclaimer, the term of this patent is extended or adjusted under 35 U.S.C. 154(b) by 0 days.

(21) Appl. No.: 16/066,570

(22) PCT Filed: Jan. 13, 2017

(86) PCT No.: PCT/EP2017/050669
§ 371 (c)(1),
(2) Date: Jun. 27, 2018

(87) PCT Pub. No.: WO2017/121851
PCT Pub. Date: Jul. 20, 2017

(65) Prior Publication Data

US 2018/0355618 A1 Dec. 13, 2018

(30) Foreign Application Priority Data

Jan. 15, 2016 (EP) ..... 16151625

(51) Int. Cl.
*E04F 13/08* (2006.01)
*E04F 15/04* (2006.01)
*E04F 15/02* (2006.01)

(52) U.S. Cl.
CPC ..... *E04F 13/0803* (2013.01); *E04F 13/0801* (2013.01); *E04F 13/0894* (2013.01);
(Continued)

(58) Field of Classification Search
CPC ..... E04F 15/02044; E04F 2201/0517; E04F 2201/0115; E04F 13/0803; E04F 13/0801;
(Continued)

(56) References Cited

U.S. PATENT DOCUMENTS 6,339,908 B1 * 1/2002 Chuang ..... E04F 15/04 52/177
6,449,918 B1 * 9/2002 Nelson ..... E04F 15/04 52/582.1

(Continued)

FOREIGN PATENT DOCUMENTS

EP 2 492 416 8/2012
WO WO 94/26999 11/1994

(Continued)

OTHER PUBLICATIONS

International Standard ISO 24334 (1st ed. 2006), "Laminate floor coverings—Determination of locking strength for mechanically assembled panels" (excerpt).

*Primary Examiner* — Brian E Glessner
*Assistant Examiner* — Adam G Barlow
(74) *Attorney, Agent, or Firm* — Levy & Grandinetti

(57) ABSTRACT

Described is a set of panels (1,2), each panel comprising: • a top surface (5) and a bottom surface (4); • a first edge (6) and a second edge (7) parallel to the first edge (6), said edges (6, 7) extending between said top and bottom surfaces (5, 4); • a first groove (10) provided in the bottom surface (4) of each panel, said first groove (10) extending parallel to and along the first edge (6) of the panel; • a second groove (11) provided in the bottom surface (4) of each panel, said second
(Continued)

groove (11) extending parallel to the first groove (10) along the second edge (7) of the panel; • a locking profile (3) allowing locking a first panel (1) with its first edge (6) to the second edge (7) of a second panel (2), said locking profile (3) comprising a base (16) and at least three protruding rims (17, 18, 19) extending parallel to one another in the longitudinal direction of the locking profile (3), a first rim (17) pressed in the first groove (10) of a first panel (1) and a second rim (18) situated in between the first and third rims (17, 19) of each locking profile (3) and cooperating with a part of the first panel (1) such that a section (13) of the bottom surface (4) of the first panel (1) is clamped between the first rim and the second rim (17, 18) of the locking profile (3), the third rim (19) configured to fit in the second groove (11) of a second panel (2) thereby locking the second panel (2) to the first panel (1), characterised in that at least the second rim (18) is continuous along the entire length of the locking profile (3). Further described is a method of manufacturing the set of panels.

17 Claims, 8 Drawing Sheets

(52) U.S. Cl.
CPC ..... *E04F 15/02* (2013.01); *E04F 15/02038* (2013.01); *E04F 15/02044* (2013.01); *E04F 15/04* (2013.01); *E04F 2015/0205* (2013.01); *E04F 2201/0115* (2013.01); *E04F 2201/0153* (2013.01); *E04F 2201/023* (2013.01); *E04F 2201/042* (2013.01); *E04F 2201/043* (2013.01); *E04F 2201/0511* (2013.01); *E04F 2201/0517* (2013.01)

(58) Field of Classification Search
CPC ..... E04F 15/02; E04F 15/04; E04F 15/02038; E04F 13/0894
USPC ..... 52/582.1, 584.1, 586.1, 506.05, 509
See application file for complete search history.

(56) References Cited

U.S. PATENT DOCUMENTS

| | | | | |
|---|---|---|---|---|
| 7,051,486 | B2 * | 5/2006 | Pervan | E04F 15/04 52/584.1 |
| 7,171,790 | B2 * | 2/2007 | Mei | E04F 15/04 52/584.1 |
| 7,805,903 | B2 * | 10/2010 | Liu | E04F 15/04 52/489.1 |
| 8,276,343 | B2 * | 10/2012 | Yang | E04F 15/02 52/584.1 |
| 8,763,340 | B2 * | 7/2014 | Pervan | E04F 15/02 52/582.2 |
| 9,856,658 | B2 * | 1/2018 | Yang | E04F 15/02038 |
| 10,060,139 | B2 * | 8/2018 | Pervan | E04F 15/087 |
| 2002/0095894 | A1 * | 7/2002 | Pervan | E04F 15/102 52/391 |
| 2005/0160694 | A1 * | 7/2005 | Pervan | B27F 1/02 52/582.1 |
| 2008/0028707 | A1 * | 2/2008 | Pervan | E04F 15/04 52/391 |
| 2009/0107076 | A1 * | 4/2009 | Kim | E04F 15/02 52/309.1 |
| 2009/0151290 | A1 * | 6/2009 | Liu | E04F 15/04 52/592.1 |
| 2014/0026513 | A1 * | 1/2014 | Bishop | E04F 15/02038 52/745.05 |
| 2015/0040508 | A1 * | 2/2015 | Zhang | E04F 15/02038 52/582.1 |
| 2016/0060880 | A1 * | 3/2016 | Stover | E04F 15/02044 52/582.2 |
| 2016/0194885 | A1 * | 7/2016 | Whispell | E04F 15/02 52/309.4 |
| 2016/0237695 | A1 * | 8/2016 | Pervan | E04F 15/10 |

FOREIGN PATENT DOCUMENTS

| | | |
|---|---|---|
| WO | WO 98/24994 | 6/1998 |
| WO | WO 98/24995 | 6/1998 |
| WO | WO 00/20706 | 4/2000 |
| WO | WO 2012/159162 | 11/2012 |
| WO | WO 2015/005860 | 1/2015 |

* cited by examiner

Fig. 1A
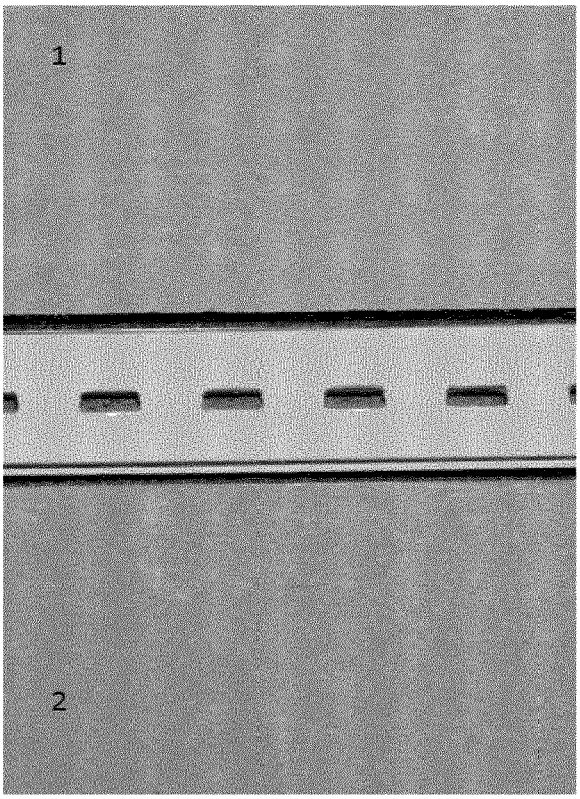
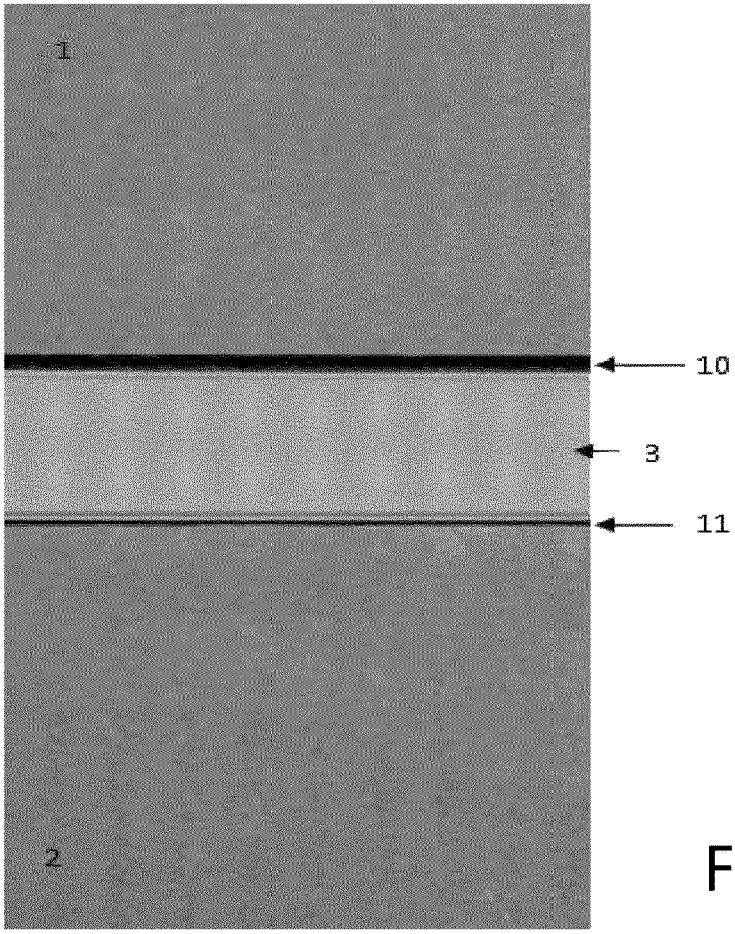
Fig. 1B

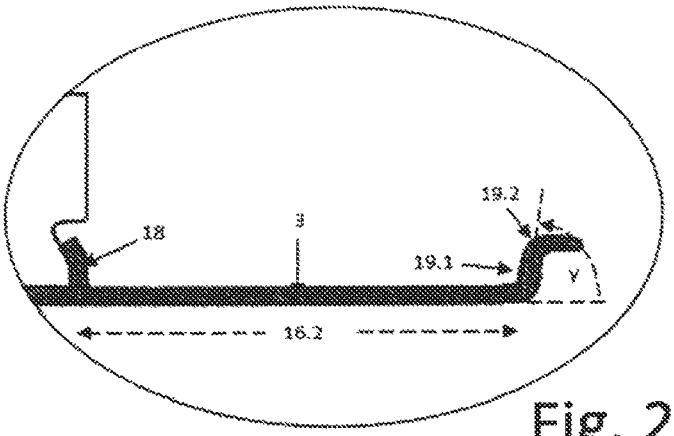
Fig. 2A.1
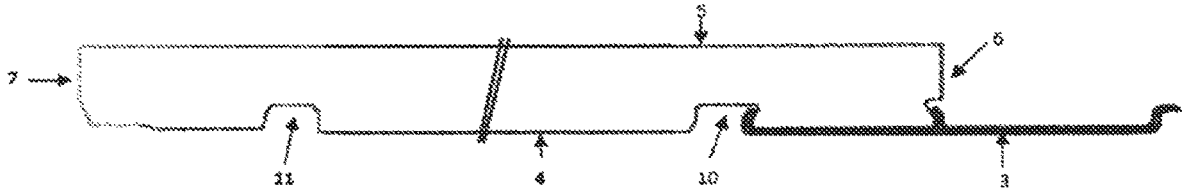
Fig. 2A
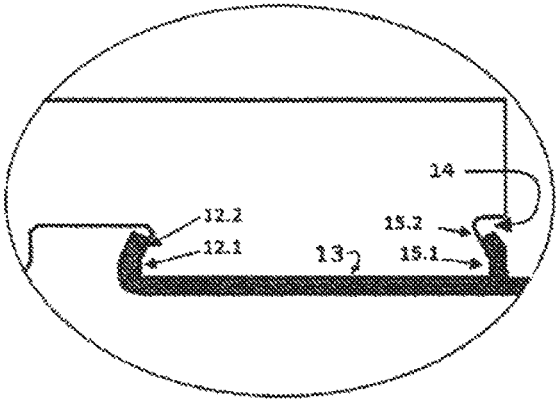
Fig. 2A.2
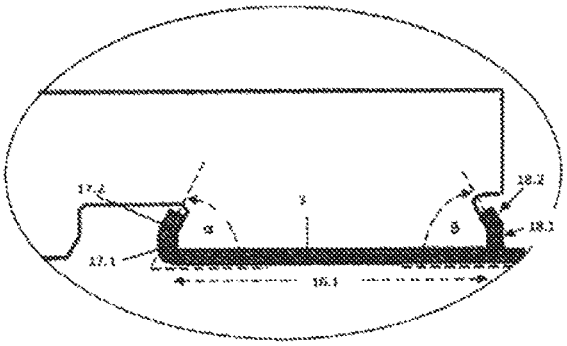
Fig. 2A.3

SET OF PANELS, METHOD FOR MANUFACTURING SUCH SET OF PANELS, ASSEMBLY OF THE PANELS AND LOCKING PROFILE USED IN SAID PANELS

FIELD OF THE INVENTION

The invention generally relates to the field of sets of panels for covering floors, ceilings or walls, in particular sets of panels comprising a plurality of panels to be joined at their adjacent edges.

BACKGROUND OF THE INVENTION

Building panels and in particular floorings used in highly frequented and heavy load environments necessarily need strong locking to prevent opening of the locked edges between two adjacent panels. It is known for such floorings to provide a locking system comprising a locking profile provided to one of the panels along the adjacent edges, wherein said locking profile is manufactured in either plastic materials or a metal material such as aluminum.

To date and as disclosed in WO98/24994 and WO98/24995, such locking profiles and in particular the metallic locking profiles are manufactured starting from metal sheets punched into a desired shape that is subsequently fixed to a panel along an edge thereof.

A first drawback of the method and locking mechanism disclosed in the prior art is that mechanically fixing the locking profiles to panels is a very slow process slowing down the entire production process of the panels. Another drawback is that the punching of metal sheets is a slow process providing only very limited design options and requiring large capex for each variation in the design of the locking profiles. Further improvements of this locking system have therefore been rare.

It is however an object of the present invention to further improve this locking system.

SUMMARY OF THE INVENTION

In a first aspect, the present invention relates to a set of panels (1,2), each panel comprising:

- a top surface (5) and a bottom surface (4);
- a first edge (6) and a second edge (7) parallel to the first edge (6), said edges (6, 7) extending between said top and bottom surfaces (5, 4);
- a first groove (10) provided in the bottom surface (4) of each panel, said first groove (10) extending parallel to and along the first edge (6) of the panel;
- a second groove (11) provided in the bottom surface (4) of each panel, said second groove (11) extending parallel to the first groove (10) along the second edge (7) of the panel;

a locking profile (3) allowing locking a first panel (1) with its first edge (6) to the second edge (7) of a second panel (2), said locking profile (3) comprising a base (16) and at least three protruding rims (17, 18, 19) extending parallel to one another in the longitudinal direction of the locking profile (3), a first rim (17) pressed in the first groove (10) of a first panel (1) and a second rim (18) situated in between the first and third rims (17, 19) of each locking profile (3) and cooperating with a part of the first panel (1) such that a section (13) of the bottom surface (4) of the first panel (1) is clamped between the first rim and the second rim (17, 18) of the locking profile (3), the third rim (19) configured to fit in the second groove (11) of a second panel (2) thereby locking the second panel (2) to the first panel (1), characterised in that at least the second rim (18) is continuous along the entire length of the locking profile (3).

In contrast to the general assumptions in the business of flooring (cf. WO94/26999) Applicant has now surprisingly discovered that by providing a continuous second rim, far greater control of the design of the locking profile and far greater freedom of design of the locking profile can be obtained allowing further improving the locking strength of the locked panels, while at the same time drastically improving production time of the locking profiles and the speed at which the locking profiles can be fixed to the panels.

In particular, the Applicant has discovered that by manufacturing the locking profile with a continuous second rim, the angles of the rims of the locking profile interacting with the panels can be designed such as to strongly increase the locking strength when compared to locking profiles made of punched metal sheets and that, apart from the increased strength, the locking between adjacent panels with the locking profile according to the invention provides an improved stability of the lock.

As illustrated in FIG. 1A, showing a partial view of the bottom side of two assembled panels with a locking profile according to the prior art and in FIG. 1B, showing a similar view with a locking profile according to the present invention, the present invention does not necessitate a partial damaging (punching) of the locking profile.

The preferred method of manufacturing the locking profile of the set of panels according to the present invention is by extrusion.

In a second aspect, the present invention relates to method of manufacturing a set of panels (1, 2), the method comprising:

a. providing a first panel (1) having:
- a top surface (5) and a bottom surface (4);
- a first edge (6) and a second edge (7) parallel to the first edge (6), said edges (6, 7) extending between said top and bottom surfaces (5, 4);
- a first groove (10) provided in the bottom surface (4) of each panel (1, 2), said first groove (10) extending parallel to and along the first edge (6) of the panel;
- a second groove (11) provided in the bottom surface (4) of each panel (1, 2), said second groove (11) extending parallel to the first groove (10) along the second edge (7) of the panel;

b. providing a locking profile (3) comprising a base (16) and at least three protruding rims (17, 18, 19) extending parallel to one another in the longitudinal direction of the locking profile (3), wherein at least a second rim (18) situated between a first rim (17) and a third rim (19) is continuous along the entire length of the locking profile (3);

c. positioning the second rim (18) of the locking profile (3) against an abutment surface (15) of the first panel (1);

d. pressing the first rim (17) of said locking profile (3) in the first groove (10) of the first panel (1), such that a section (13) of the panel is clamped between the first rim (17) and the second rim (18) of the locking profile (3).

In a third aspect, the present invention relates to locking profile (3) for locking two adjacent panels of a set of panels (1, 2), said locking profile (3) comprising a base (16) and at least protruding rims (17, 18, 19) extending parallel to one another in the longitudinal direction of the locking profile (3), whereby a first rim (17) and a second rim (18) situated between the first and third rims (17, 19) define a clamp allowing clamping a section of a panel therebetween and whereby the second rim (18) is continuous over the entire length of the locking profile (3).

In a fourth aspect, the present invention relates to an assembly of panels comprising a set of panels (1, 2) as defined in any of claims 1-12.

BRIEF DESCRIPTION OF THE DRAWINGS

FIG. 1A shows a picture of a partial view of the bottom side of two assembled panels with a locking profile according to the prior art;

FIG. 1B shows a picture of a partial view of the bottom side of two assembled panels with a locking profile according to the present invention;

FIG. 2A schematically represents a first panel of the set of panels of the present invention and with FIGS. 2A.1, 2A.2 and 2A.3 representing in more detail some specific parts of the first panel and locking profile provided on the first panel as represented in FIG. 2A;

DETAILED DESCRIPTION

Figure 2B:
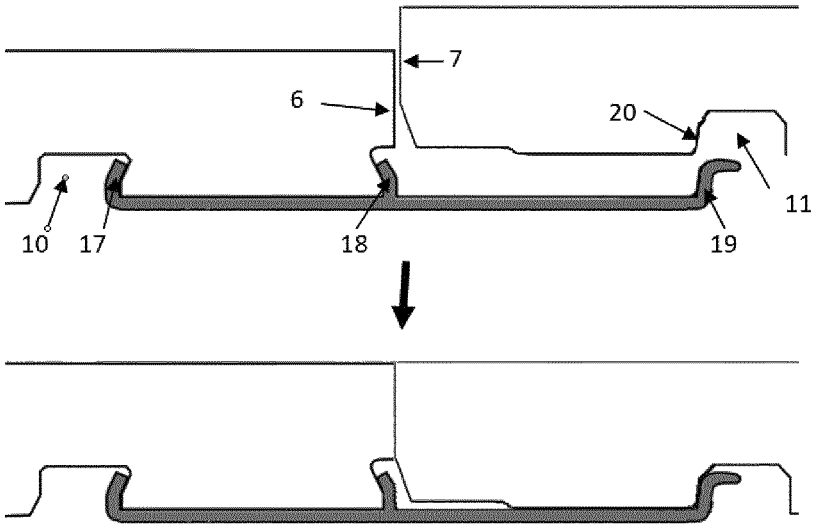
FIG. 2B schematically shows a method of assembling a set of panels according to the present invention.

The present invention concerns a set of panels, typically for covering floors, ceilings or walls.

FIG. 2A shows a panel (1) of such a set of panels, with a locking profile (3) clamped thereon. Each panel of the set of panels has a bottom surface (4), a top surface (5)—preferably finished with a decor and/or a wear layer, not shown in the figures—and a plurality of edges extending between the bottom and top surfaces.

In the embodiment represented in FIG. 2A, the panels are rectangular shaped with a pair of parallel longitudinal (long) edges (6-7) and a pair of parallel transversal (short) edges (8-9). Along each longitudinal edge (6, 7) a groove is provided in the bottom surface (4) of each panel, a first groove (10) extending parallel to and along the first edge (6) over the entire length of the panel and a second groove (11) extending parallel to and along the second edge (7).

At its side most proximate to the first edge (6) of the panel, the first groove (10) is partially delimited by a sidewall or abutment surface (12) that preferably at least partially extends slanting in view of the direction normal to the bottom surface (4) such that this sidewall inclines towards the first edge of the panel in a direction from the bottom surface (4) towards the top surface (5) of the panel and as such defines a wedge shaped section (13) in the panel between this sidewall (12) and the first edge (6). In the embodiment represented in FIG. 2B, this sidewall (12) comprises two wall parts, a first wall part (12.1), most proximate to the bottom surface (4) of the panel extending substantially parallel to the direction normal to the bottom surface (4) and a second wall part (12.2) slanting in view of the first wall part (12.1) to define the wedge shaped section (13) as described supra.

Preferably, the first panel (1) further comprises a recess (14) provided in the first edge (6) that in this case is delimited by a sidewall (15) comprising a first part (15.1), most proximate to the bottom surface (4) of the panel extending substantially parallel to the direction normal to the bottom surface (4) and a second wall part (15.2) slanting in view of the first wall part inclined towards the second edge (7) of the panel in a direction from the bottom surface (4) towards the top surface (5) of the panel and as such defines the wedge shaped section (13) in the panel between the first edge (6) and the first groove (10).

As shown in FIG. 2B, two panels of the set of panels are coupled to one another along their facing longitudinal edges (6, 7) by means of the locking profile (3). The locking profile (3) comprises a base (16) and at least three protruding rims (17, 18, 19) extending parallel to one another in the longitudinal direction of the locking profile (3). A first rim (17) is lodged in the first groove (10) along the first edge (6) of the first panel and a third rim (19) that, in an assembled state of the set of panels, is lodged in the second groove (11) along the second edge (7) of the second panel. The second rim (18), situated between the first and third rims of the locking profile (3), cooperates with a part of the first edge (6) of the first panel (1), such that a section of the first panel (1) is clamped between the first and second rims (17, 18) of the locking profile. In the embodiment represented in FIG. 2B, the second rim (18) is situated in the recess (14) provided in the first edge (6) of the first panel (1).

According to the present invention, the second rim (18) is continuous and extends over the entire length of the locking profile (3). Preferably also the first and third rims (17, 19) are continuous and extend over the entire length of the locking profile (3).

As represented in FIG. 2B, the first rim (17) of the locking profile (3) preferably comprises two parts: a first part (17.1), most proximate to the base (16), extending in a direction substantially normal to the bottom surface (4) of the panel (1) when the locking profile (3) is clamped thereon; and a second part (17.2), most distant from the base (16) that is inclined in view of the first part (17.1) towards the second rim (18) over an angle $\alpha$ ranging between 50° and 90°, preferably between 60° and 70°. When the locking profile (3) is clamped on the first panel (1), the first and second parts (17.1 and 17.2) of the first rim (17) thereby cooperate with, respectively, the first wall part (12.1) and second wall part (12.2) of the first groove (10). The second rim (18) of the locking profile (3) preferably comprises two parts: a first part (18.1), most proximate to the base (16), extending in a direction substantially normal to the bottom surface (4) of the panel when the locking profile (3) is clamped thereon; and a second part (18.2), most distant from the base (16) that is inclined in view of the first part (18.1) towards the first rim (17) over an angle $\beta$ ranging between 60° and 80°, preferably between 65° and 75°. When the locking profile (3) is clamped on the first panel (1), the first and second parts (18.1 and 18.2) of the second rim (18) thereby cooperate with, respectively, the first wall part (15.1) and second wall part (15.2) of the recess (14). The above specific design of the first groove (10) and recess (14) of the first panel (1) and of the first and second rims (17, 18) of the locking profile (3) allows obtaining a strong and fail-proof clamping of the locking profile (3) on the first panel (1), whereby accidental release of the locking profile (3) is prevented.

The third rim (19) of the locking profile (3) preferably comprises two parts: a first part (19.1), most proximate to the base (16) of the locking profile (3); and a second part (19.2), most distant from the base (16). The first part (19.1) is inclined away from the second rim (18) over an angle γ with the base (16) of the locking profile (3) of at least 75°, preferably between 80°-90°, most preferably between 80°-86°.

Alternative to the two part designs of the first, second and third rims (17, 18, 19), any or all can be designed as a rim extending in a same direction over its entire height, in which case this direction is preferably inclined at angles α, β and γ respectively as described hereinabove.

Preferably, the locking profile (3) is an extruded profile manufactured in a plastic material (e.g. a glass-fiber reinforced plastic material, such as polystyrene) or preferably, in a metal material such as aluminum.

In order to assemble the set of panels (1, 2) and as represented in FIG. 2B, the first panel (1) is positioned in place, with its bottom surface (4) and the base (16) of the locking profile (3) resting on a support surface (not shown). In this position, the part of the locking profile (3) between the second rim (18) and the third rim (19) is exposed and ready to receive an edge portion of the second panel (2). By positioning the second edge (7) of the second panel (2) against the first edge (6) of the first panel (1) and subsequently pressing the second panel (2) towards the support surface, the third rim (19) of the locking profile is pressed in the second groove (11) of the second panel (2) such that it firmly contacts a sidewall (20) of that second groove (11) most proximate to the second edge (7) of the second panel and thereby locks the second panel from moving in view of the first panel in a direction perpendicular to the first and second edges (6, 7) of the first and second panels (1, 2) in the plane of the bottom surfaces (4) of both panels (1, 2). Such locking is commonly addressed as a horizontal lock between the panels.

The strength of the horizontal lock, defined as the force needed to tear both panels apart in the direction perpendicular to the first and second edges (6, 7) of the first and second panels (1, 2) in the plane of the bottom surfaces (4) of both panels (1, 2), is apart from material failure of the panels, dependent on the strength of the locking profile.

When manufacturing the locking profile in aluminum and with a base having a thickness of at least 0.4 mm, for example 0.6 mm, a locking strength $F_{MAX}$ of at least 3 kN/m can be achieved when measured according to ISO24334 (2006), more preferably at least 4 kN/m.

The thickness of the base (16) and the rims (17, 18, 19) preferably ranges between 0.4 mm and 1.2 mm, preferably between 0.5 mm and 0.8 mm. In some embodiments of the locking profile as explained further, the first and/or second rim may deviate from these ranges.

In addition hereto it is mentioned that the thickness of the base (16) of the locking profile (3) may vary between a first section (16.1) extending between the first rim (17) and the second rim (18) and a second section (16.2) extending between the second rim (18) and third rim (19).

Figure 7A:
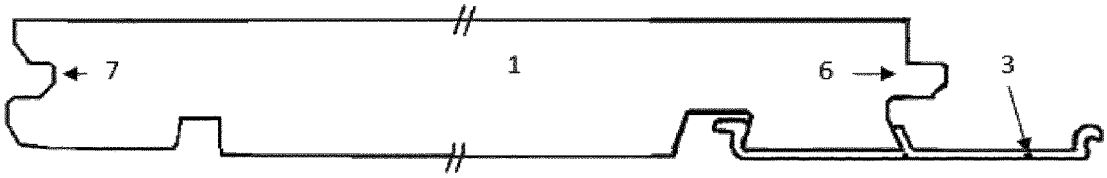
FIGS. 7A and 7B show an alternative embodiment of FIGS. 2A and 2B respectively.
Figure 7B:
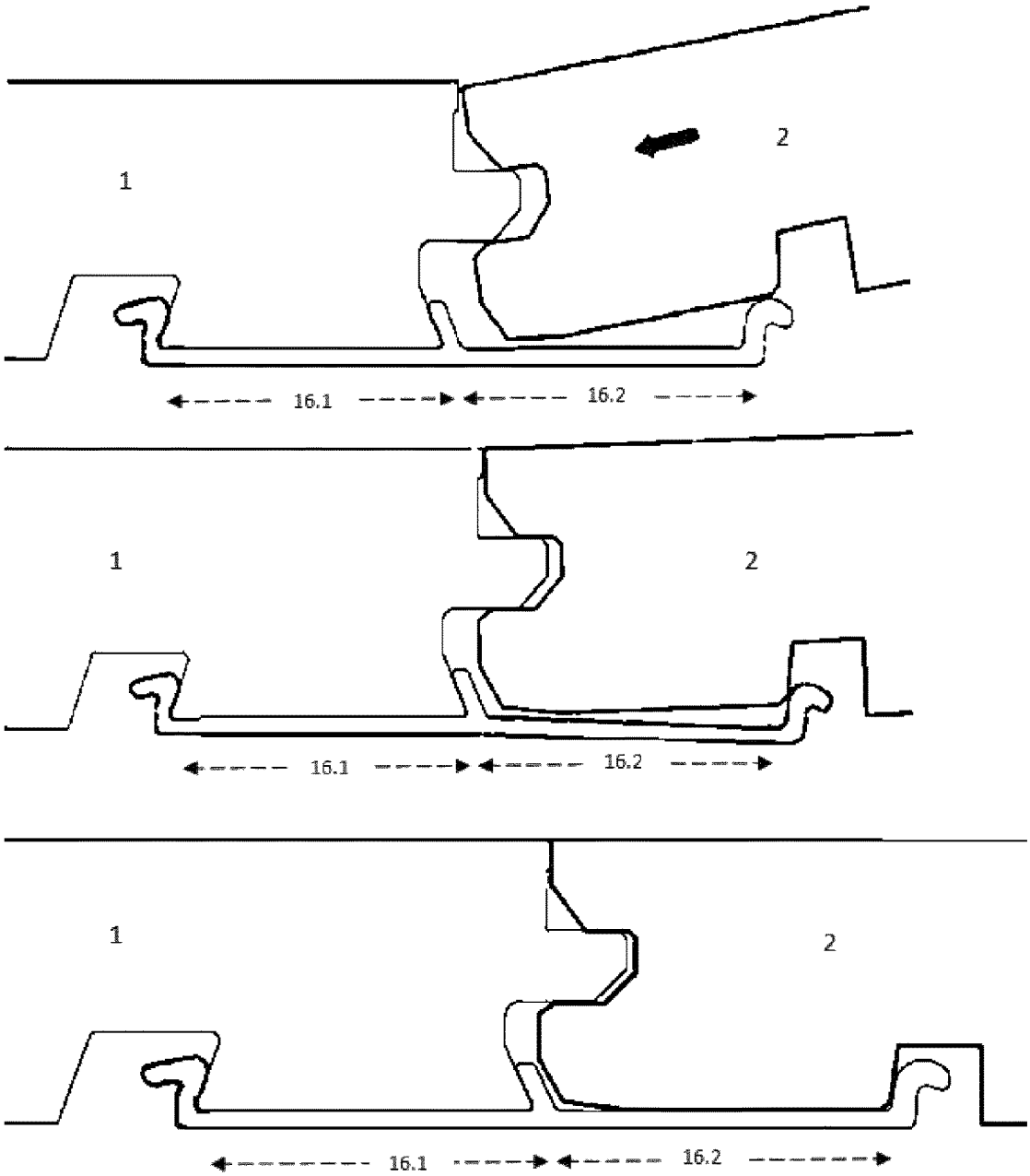

For the second section (16.2) the thickness is preferably chosen to allow elastic bending of the locking profile (3) as shown in FIG. 7B while yet providing sufficient stretch resistance, this to allow easy assembly of the set of panels (1,2) by inserting the second edge (7) of the second panel (2) between the second and third rims (17, 18) of the locking profile (3), whereas the thickness of the first section (16.1) is preferably chosen to provide a desired clamping of the locking profile (3) on the first panel (1).

As mentioned supra the locking profiles (3) are preferably manufactured by extrusion. Once extruded, the locking profiles (3) are cut to a desired length, whereafter the cutted profiles (3) are stacked by positioning a plurality of locking profiles in a first orientation parallel to one another to create a first layer of locking profiles (3) and subsequently positioning a plurality of locking profiles in a second orientation parallel to one another and perpendicular to the first orientation to create a second layer of locking profiles (3) on top of the first layer of locking profiles. A third layer of locking profiles (3) positioned in the first orientation can subsequently be placed on the second layer of locking profiles and so on, thereby obtaining a cross-stack (21) of locking profiles (3) shown in FIG. 3A.

Figure 3A:
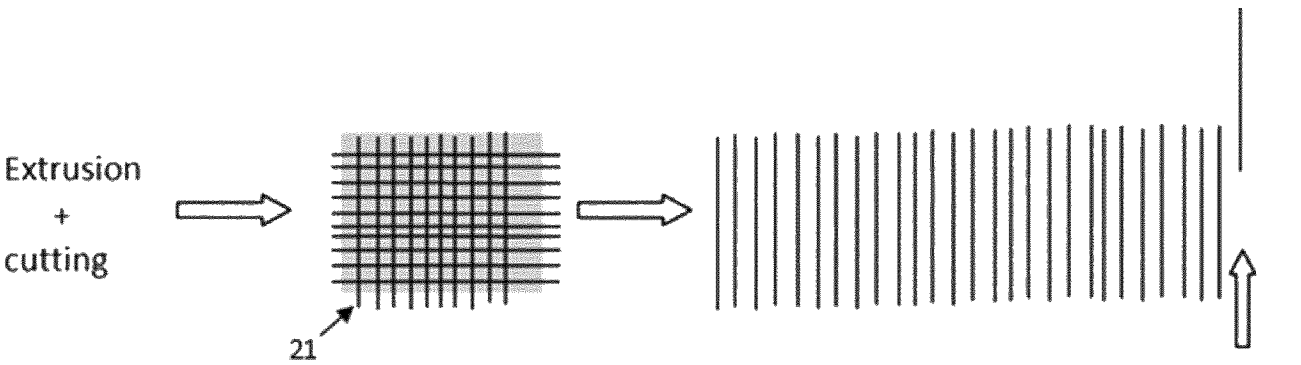
FIGS. 3A-D schematically represent a method of manufacturing a set of panels according to the present invention.
Figure 3B:
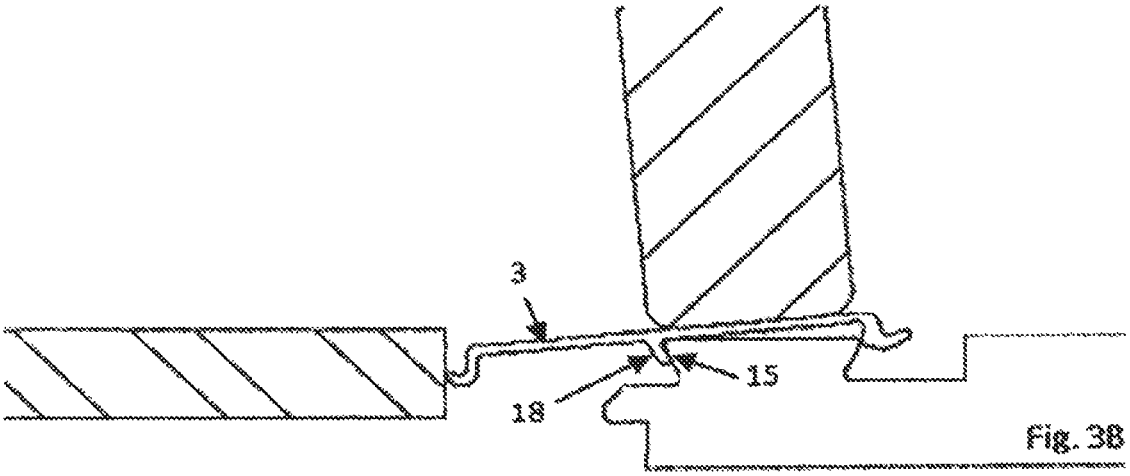
Figure 3C:
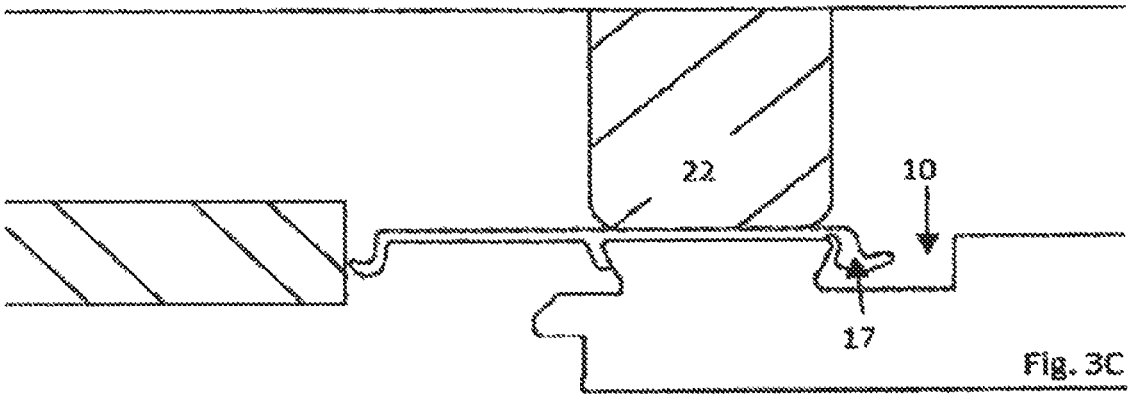

As schematically represented in FIG. 3A, the locking profiles (3) are subsequently de-stacked and positioned parallel to one another and in a predetermined position on a conveyor for feeding the locking profiles (3) one by one to a panel-assembly apparatus. In the panel-assembly apparatus, as represented in FIG. 3B, one locking profile (3) is first aligned with the first edge (6) of a first panel (1) by positioning the second rim (18) of the locking profile (3) against the first edge (6), preferably against sidewall (15) of the first edge (6), of the first panel (1). Subsequently and as shown in FIG. 3C, the locking profile (3) is pressed against the bottom surface (4) of the panel (1), thereby pressing the first rim (17) of the locking profile (3) in the first groove (10) of the first panel (1). This pressing operation is preferably performed by guiding a first press-roll (22) over the locking profile (3).

Figure 3D:
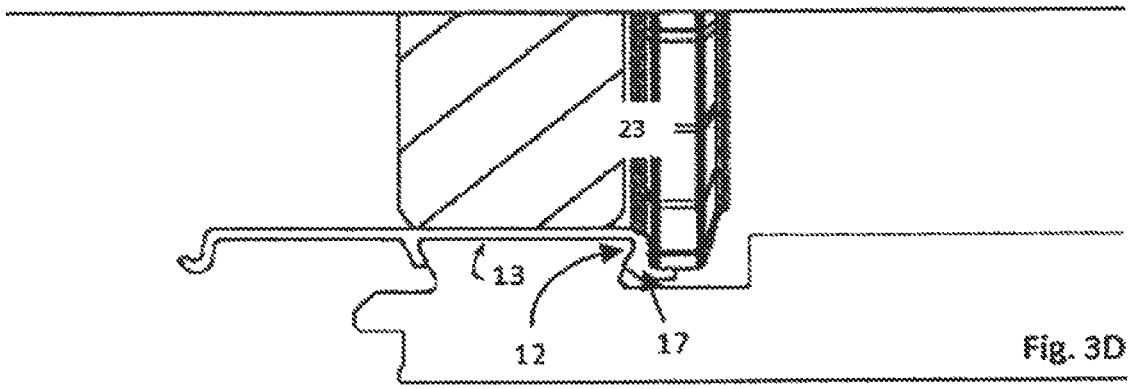

Subsequently, as represented in FIG. 3D, the first rim (17) of the locking profile (3) is at least partially bent by pressing the first rim (17) firmly against the abutment or sidewall surface (12) of the first groove (10) thereby ensuring that the wedge-shaped section (13) of the first panel (1) is adequately clamped between the first and second rim (17, 18) of the concerning locking profile (3). This pressing is preferably performed by a second press-roll assembly (23) which preferably presses a second part (17.2) of the first rim (17) firmly against or even partially into second wall part (12.2).

It is preferred that the first rim (17) of the locking profile (3), when extruded, is configured to allow bending the first rim (17) towards the second rim (18), for clamping said locking profile (3) on a panel (1), while still providing sufficient resistance against bending the first rim (17) backwards such that the tensile strength of the locking profile (3), measured in the plane of the base (16) of the locking profile (3) is at least 3 kN/m measured in accordance with ISO24334(2006), preferably at least 4 kN/m.

According to a preferred embodiment, the first rim (17) is permanently deformed by the bending operation. In case the locking profile is manufactured in a plastic material, heat may be applied to the first rim (17) just before, during or after bending the first rim (17) to make the deformation of the first rim permanent thereby ensuring clamping of the locking profile (3) on a panel (1).

Figure 4:
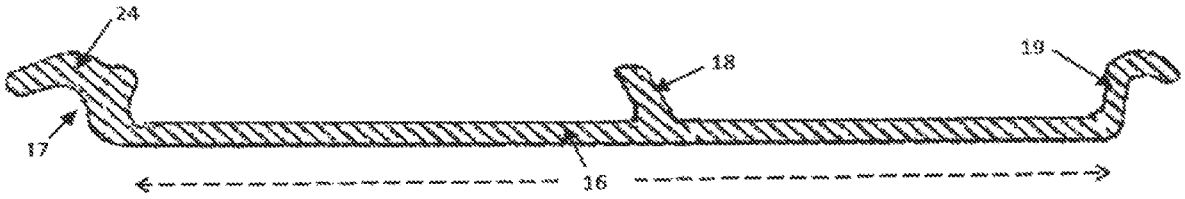
FIGS. 4, 5A and 6 show a cross-section of locking profiles according to alternative embodiments of the present invention.
Figure 5B:
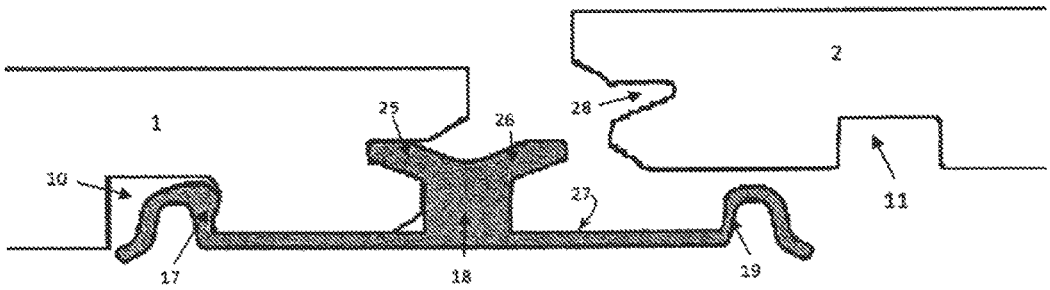
FIG. 5B shows the locking profile of FIG. 5A when provided on a first panel and ready to cooperate with a second panel.
Figure 5A:
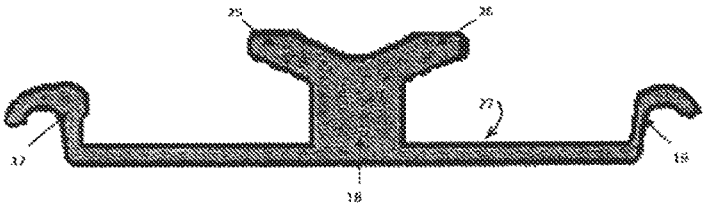
Figure 6:
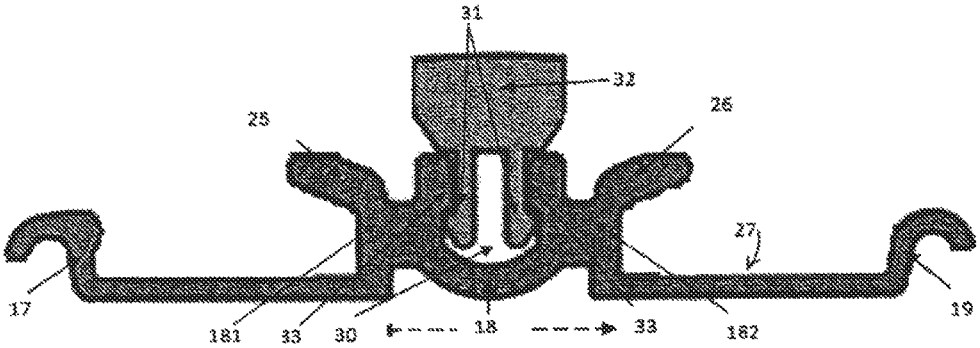

FIGS. 4-6 represent alternative embodiments of a locking profile (3) of the set of panels according to the present invention.

The locking profile (3) shown in FIG. 4, comprises a base (16) and three protruding rims (17, 18, 19) extending parallel to one another in the longitudinal direction of the locking profile (3). The first rim (17) configured to be lodged in the first groove (10) along the first edge (6) of the first panel (1), in this case comprises a protrusion (24) protruding from the first rim (17) in the direction of the second rim (18). This protrusion (24), positioned at a distance from the base (16) of the locking profile (3), facilitating clamping the locking profile (3) on the first panel (1) as the inclined second part (17.2) of the first rim (17) of the locking profile described with reference to FIG. 2A.

The locking profile shown in FIG. 5, comprises a base (16) and three protruding rims (17, 18, 19) extending parallel to one another in the longitudinal direction of the locking profile (3). In this embodiment, the second rim (18) comprises a first wing (25) and a second wing (26).

The first wing (25) is inclined towards the first rim (17) of the locking profile (3) and has the same function of clamping the locking profile (3) on the first panel (1) as the inclined second part (18.2) of the second rim (18) of the locking profile described with reference to FIG. 2A. The second wing (26) is inclined towards the third rim (19) and as such defines a groove (27) between the base (16) of the locking profile (3), the second rim (18) and the second wing (26). In this embodiment, the second edge (7) of each panel comprises a recess (28) configured to accommodate the second wing (26). This design of the locking profile (3) and the second edge (7) of the panels prevents a movement between the first and second panels (1,2) in a direction normal to the bottom surfaces of the panels (commonly referred to as a vertical lock).

The locking profile (3) shown in FIG. 6, comprises a base (16) and three protruding rims (17, 18, 19) extending parallel to one another in the longitudinal direction of the locking profile (3). In this case, the second rim (18) is designed as a composite rim having two or more parallel and spaced apart rims (181, 182) or else can be described as a rim (18) having a central void.

In this case both spaced apart rims (181 and 182) comprise a wing. The first spaced apart rim (181), situated most proximate to the first rim (17), comprises a wing (25) that is inclined towards the first rim (17) of the locking profile (3). This rim (181) has the same function as the second rim (18) of the locking profile described with reference to FIG. 2B. The second spaced apart rim (182) located most distant from the first rim (17) comprises a second wing (26), inclined towards the third rim (19) and as such defines a groove (27) between the base (16) of the locking profile (3), the second rim (18) and the second wing (26). Between both spaced apart rims (181) and (182) is a slot (30) comprising in this case a female snap-fit locking means (31), wherein a spacer (32) having a corresponding male snap-fit locking means (33) is disposed. The spacer is positioned between the facing edges (6, 7) of the first and second panels (1,2) locked by the locking profile. Clearly, the locking between spacer (32) and locking profile (3) can be executed in accordance with a multitude of alternatives without departing from the present invention.

In FIGS. 7A and 7B an assembly of panels is shown that differs from the embodiment of FIG. 2A in that the first and second edges (6, 7) of the panels (1, 2) are configured as a tongue and groove system allowing vertically locking both panels once assembled.

In the represented embodiment, the tongue is provided on the first edge (6) of the first panel (1), while the groove is provided in the second edge (7) of the second panel (2), yet clearly it is also possible to provide the tongue on the second edge (7) of the second panel (2) and to provide the groove in the first edge (6) of the first panel (1).

Further it is mentioned that the thickness of the base (16) of the locking profile may vary between a first section (16.1) extending between the first rim (17) and second rim (18) and a second section (16.2) extending between the second rim (18) and the third rim (19).

For the second section (16.2) the thickness is preferably chosen to allow elastic bending of the locking profile (3) as shown in FIG. 7B while yet providing sufficient stretch resistance, this to allow easy assembly of the set of panels (1, 2) by inserting the second edge (7) of the second panel (2) between the second and third rims (18, 19) of the locking profile (3), whereas the thickness of the first section (16.1) is preferably chosen to provide a desired clamping of the locking profile (3) on the first panel (1).

With respect to the detailed description of the invention here above, the facing edges of two adjacent panels have been addressed by the first and second edges (6 and 7), without limitation to the shape of the panels and without specifying, in case the panels are rectangular, whether the concerned first and second edges are longitudinal edges (long edges) or transversal edges (short edges). It is therefore clear that for the above description, no limitation to position or length of the pair of parallel edges was intended.

Figure 8:
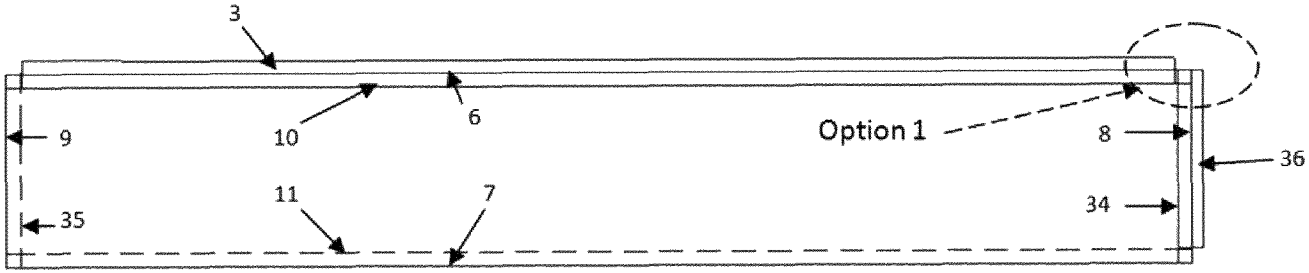
FIGS. 8 and 9 show a panel according to the present invention with two alternative configurations for clamping multiple locking profiles thereon.
Figure 9:
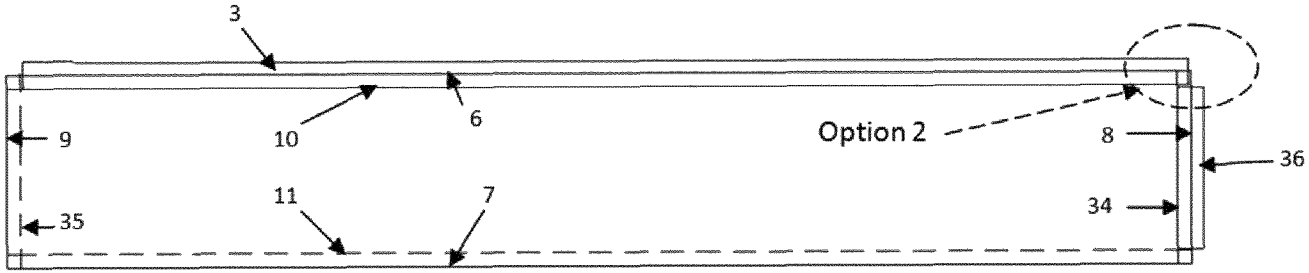

Now, in some cases it is desirable to provide locking profiles on more than one pair of facing edges of adjacent panels. As represented in FIGS. 8 and 9, each panel comprises in addition to the above first and second edges (6, 7) and the corresponding locking profile (3):

- a third edge (8) and a fourth edge (9) parallel to the third edge (8), said edges extending between the top surface (5) and bottom surface (4) of the panel (1);
- a third groove (34) provided in the bottom surface (4) of each panel, said third groove (34) extending parallel to and along the third edge (8) of the panel (1);
- a fourth groove (35) provided in the bottom surface (4) of each panel, said fourth groove (35) extending parallel to the third groove (34) along the fourth edge (9) of the panel (1);
- a second locking profile (36) allowing locking a first panel (1) with its third edge (8) to the fourth edge (9) of a third panel, said second locking profile (36) comprising a base (16) and at least three protruding rims (17, 18, 19) extending parallel to one another in the longitudinal direction of the locking profile (36), a first rim (17) disposed in the third groove (34) of a first panel (1) and a second rim (18) situated in between the first and third rims (17, 19) of each second locking profile (36) and cooperating with a part of the first panel (1) such that a section (13) of the first panel (1) is clamped between the first rim (17) and the second rim (18) of the second locking profile (36), the third rim (18) configured to fit in the fourth groove (35) of a third panel thereby locking the third panel to the first panel (1), wherein at least the second rim (18) of the second locking profile (36) is continuous along the entire length of said second locking profile (36).

In such a configuration, overlapping locking profiles are to be prevented. Therefore it is preferred that the locking profile disposed at a long side of the panel is allowed to extend into the corner region defined by the first and third edges of the panel, whereas the locking profile disposed at the short edge of the panel does not extend into that corner portion or vice versa.

Further, according to the present invention there is no real limit on the minimum and maximum length of the locking profile disposed along a single side of a panel and lengths varying from 5 cm up to several meters can be envisaged. However, in order to obtain a rigid lock with sufficient $F_{MAX}$ locking strength, it is preferred that in case the locking profile has a length that is a multitude smaller than the length of the side on which it is disposed, a plurality of locking profiles is disposed on that same edge of the panel, with the sum of the lengths of the locking profiles disposed on that edge being equal to or larger than at least 80% of the total length of the concerned side edge.

For all the above described embodiments, the panels can be be made from many different materials or combinations of materials as long as it is feasible to make the retaining profiles as described hereinbefore, on their edges.

The panels may be wood-based (e.g. solid wood, a fiberboard (MDF, HDF), or a particle board). The panels may also be made of, or at least comprising a layer of, synthetic material. The term "synthetic material" as used in the context of the current invention can be a single polymer or a blend of two or more polymers. The synthetic material can be, for example, a thermoplastic polymer, a thermosetting polymer, a rubber (elastomer), or any combinations thereof. In one particular example, the polymeric material is a thermoplastic polymer that includes vinyl containing thermoplastics such as polyvinyl chloride, polyvinyl acetate, polyvinyl alcohol, and other vinyl and vinylidene resins and copolymers thereof; polyethylenes such as low density polyethylenes and high density polyethylenes and copolymers thereof; styrenes such as ABS, SAN, and polystyrenes and copolymers thereof, polypropylene and copolymers thereof; saturated and unsaturated polyesters; acrylics; polyamides such as nylon containing types; engineering plastics such as polycarbonate, polyimide, polysulfone, and polyphenylene oxide and sulfide resins and the like. The synthetic material compound used to form the panel or a layer thereof can be a PVC powder compound that has good impact strength, ease of processing, high extrusion rate, good surface properties, excellent dimensional stability, and indentation resistance.

The panels may also comprise composite materials, or one or more layers thereof, such as wood-plastic composites (WPC), referring to a composite structure comprising a wood-based material and a synthetic material. The panel may comprise multiple layers which can be identical or different with respect to composition and/or physical properties.

The invention claimed is:

1. A set of panels, each panel comprising:

a top surface and a bottom surface;

a first edge and a second edge parallel to the first edge, said edges extending between said top and bottom surfaces;

a first groove provided in the bottom surface of each panel, said first groove extending parallel to and along the first edge of the panel;

a second groove provided in the bottom surface of each panel, said second groove extending parallel to the first groove along the second edge of the panel;

a locking profile allowing locking a first panel with its first edge to the second edge of a second panel, said locking profile comprising a base and at least three protruding rims extending parallel to one another in the longitudinal direction of the locking profile, a first rim pressed in the first groove of a first panel and a second rim situated in between the first and third rims of each locking profile and cooperating with a part of the first panel such that a section of the bottom surface of the first panel is clamped between the first rim and the second rim of the locking profile, the third rim configured to fit in the second groove of a second panel thereby locking the second panel to the first panel, wherein at least the first rim and the second rim are continuous along the entire length of the locking profile;

wherein the first groove defines an abutment surface having two wall parts for the first rim, which abutment surface is angled in view of the bottom surface such that the section of the first panel clamped between the first rim and the second rim of the locking profile increases in width towards the bottom surface of the panel, and wherein at least the first rim comprises a hook at its free end, said hook extending in a direction facing away from the second rim.

2. The set of panels according to claim 1, wherein said locking profile is manufactured by extrusion.

3. The set of panels according to claim 1, wherein said locking profile is manufactured from a metal material, preferably aluminum.

4. The set of panels according to claim 1, each panel comprising a recess in its first edge, said recess extending in the longitudinal direction of the first edge, said recess at least partially accommodating the second rim of the concerned locking profile.

5. The set of panels according to claim 1, wherein said second rim is inclined towards the first rim of the locking profile.

6. The set of panels according to claim 1, the second rim comprising two wings at its free end, a first wing inclined towards the first rim of the locking profile and extending into the recess in the first edge, and a second wing inclined towards the third rim of the locking profile and extending into a recess provided along the second edge of a second panel.

7. The set of panels according to claim 1, wherein the second rim of the locking profile is a composed rim having two or more parallel and spaced apart rims, preferably configured to accommodate a spacer after locking the second panel to the first panel with a predefined distance between both panels.

8. The set of panels according to claim 1, wherein one or more locking profiles are provided along the first edge of a first panel, said one or more locking profiles having a total length equal to or larger than 80% of the length of the first edge.

9. The set of panels according to claim 1, said panels comprising:

a third edge and a fourth edge parallel to the third edge, said edges extending between the top surface and bottom surface of the panel;

a third groove provided in the bottom surface of each panel, said third groove extending parallel to and along the third edge of the panel;

a fourth groove provided in the bottom surface of each panel, said fourth groove extending parallel to the third roove along the fourth edge of the panel;

a second locking profile allowing locking a first panel with its third edge to the fourth edge of a third panel, said second locking profile comprising a base and at least three protruding rims extending parallel to one another in the longitudinal direction of the locking profile, a first rim press-fitted in the third groove of a first panel and a second rim situated in between the first and third rims of each second locking profile and cooperating with a part of the first panel such that a section of the bottom surface of the first panel is clamped between the first rim and the second rim of the second locking profile, the third rim configured to fit in the fourth groove of a third panel thereby locking the third panel to the first panel, wherein at least the second rim of the second locking profile is continuous along the entire length of said second locking profile, and wherein at least the first rim comprises a hook at its free end, said hook extending in a direction facing away from the second rim.

10. The set of panels according to claim 1, wherein the first and second edges are configured to define a tongue and groove system.

11. A locking profile for locking two adjacent panels of a set of panels, said locking profile comprising a base and at least a first, a second, and a third protruding rims extending parallel to one another in the longitudinal direction of the locking profile, whereby a first rim and a second rim, situated between the first and third rims, define a clamp allowing clamping of a wedge-shaped section of a panel therebetween, whereby the second rim is continuous over the entire length of the locking profile, wherein said second rim is inclined towards the first rim, said first rim being configured to be deformed upon assembly on a panel such as to allow clamping of the wedge-shaped section of a panel between the first and second rims, and wherein at least the first rim comprises a hook at its free end, said hook extending in a direction facing away from the second rim.

12. An assembly of panels comprising a set of panels as defined in claim 1.

13. The set of panels according to claim 2, wherein said locking profile is manufactured from a metal material, preferably aluminum.

14. The set of panels according to claim 13, each panel comprising a recess in its first edge, said recess extending in the longitudinal direction of the first edge, said recess at least partially accommodating the second rim of the concerned locking profile.

15. The set of panels according to claim 14, wherein said second rim is inclined towards the first rim of the locking profile.

16. The set of panels according to claim 15, wherein the first groove defines an abutment surface for the first rim, which abutment surface is angled in view of the bottom surface such that the section of the first panel clamped between the first rim and the second rim of the locking profile increases in width towards the bottom surface of the panel.

17. The set of panels according to claim 16, the second rim comprising two wings at its free end, a first wing inclined towards the first rim of the locking profile and extending into the recess in the first edge, and a second wing inclined towards the third rim of the locking profile and extending into a recess provided along the second edge of a second panel.

* * * * *